US006419546B1

(12) United States Patent
Akashi et al.

(10) Patent No.: US 6,419,546 B1
(45) Date of Patent: Jul. 16, 2002

(54) DOLL MOVABLE STRUCTURE FOR LOIN AND GROIN

(75) Inventors: Tatsuhiko Akashi; Toshiaki Okubo, both of Tokyo (JP)

(73) Assignees: Medicom Toy Corporation; Time House Corporation, both of Tokyo (JP)

( * ) Notice: Subject to any disclaimer, the term of this patent is extended or adjusted under 35 U.S.C. 154(b) by 0 days.

(21) Appl. No.: 09/405,107

(22) Filed: Sep. 27, 1999

(30) Foreign Application Priority Data

Sep. 25, 1998 (JP) ..... 10-288919

(51) Int. Cl.[7] ..... A63H 3/46
(52) U.S. Cl. ..... 446/376; 446/381
(58) Field of Search ..... 446/97, 228, 330, 446/354, 355, 376, 377, 381, 390

(56) References Cited

U.S. PATENT DOCUMENTS 1,335,804 A * 4/1920 Trabert ..... 446/377
2,887,822 A * 5/1959 Baggott ..... 446/377
3,254,442 A * 6/1966 Ostrander ..... 446/376
3,591,976 A * 7/1971 Ostrander ..... 446/377
3,700,384 A * 10/1972 Gardel et al. ..... 446/330 X
3,982,354 A * 9/1976 Hollingsworth et al. .... 446/377
5,147,238 A * 9/1992 Kelly et al. ..... 446/337 X

* cited by examiner

*Primary Examiner*—D. Neal Muir
(74) *Attorney, Agent, or Firm*—Ronald E. Greigg

(57) ABSTRACT

A movable structure for loin and groin of toy figures is composed of a coxa member formed as a partition wall and attached to a lower portion of a body 2 of a movable jointed doll; right and left huckle bone members are installed pivotably with the coxa member, and right and left groin members are installed into installed spaces respectively formed at each of the huckle bone members. Further, the groin members have protruded fitted portions which are inserted into depressed fitted portions formed at gluteu maximus corresponding portions of the huckle bone members, respectively. Moreover, the groin members includes first joint segments that rotate respectively in relation to each of the huckle bone members such that right and left leg members open in a horizontal direction respectively and second joint segments for connecting legs provided with the first joint segments in a face contact state through projected axles respectively and combine integrally with each other, the second joint segments rotate in relation to the first joint segments such that the leg members are lifted in a fore direction, respectively. Therefore, a movable structure for loin and groin of toy figures allows the loin and groin to move naturally in the same manner as a human being when the leg members are opened in the front-back direction and/or the left-right direction respectively.

5 Claims, 13 Drawing Sheets

DOLL MOVABLE STRUCTURE FOR LOIN AND GROIN

BACKGROUND OF THE INVENTION

The present invention relates to a movable structure for loin and groin of toy figures, jointed dolls, and the like.

An example of a joint structure in relation to groin of toy figures, such as dolls or the like whose has right and left legs lifted in the horizontal and fore directions (it makes them to move) is described in Japanese Utility Model Examined Publication Hei 7-45273.

In such a structure described in the above-mentioned publication, basically, both ends of the protruded rods provided at a lower portion of a doll to a horizontal state is each provided spherical members, and a pair of separated legs includes respectively engaged depressions which engage with the spherical members. Therefore, the spherical members and depressions as a joint structure are joined suitably each other.

Therefore, the leg of the doll can be lifted horizontally and forwards through the fitted depression having cum mechanism in relative to the spheres of the rods respectively.

However, since the joint structure of the leg of the doll is very simple, it is impossible to make loin or groin of the doll to move in the same manner as human being. Therefore, when the leg is opened in the front-back direction and/or the left-right direction, the loin or groin portion of the doll does not allowed moving as natural movement of human being. In addition, because the sphere members of the protrusion rods are each engaged with the engaging depressions having cum mechanism, one of the legs has to be separated in two portions.

SUMMARY OF THE INVENTION

In view of the foregoing, it is an object of the present invention to provide a movable structure for loin and groin of toy figures that allow loin and groin to lift in the same manner as human being naturally when the leg is opened in the front-back direction and/or the fore direction. It is another object of the present invention to provide a movable structure that can join a huckle bone member and loin member rationally. It is still another object of the present invention to provide a movable structure that can be lifted the leg to a V-shaped state with rotating the huckle bone member when the leg of toy figures is lifted in the fore direction. It is a further object of the present invention to provide a movable structure that can control movement of the leg of toy figures within a range of movement in the same manner as human being.

A movable structure for loin and groin of toy figures is composed of a coxa member 11 as a partition wall attached at a lower portion of a body 2 of a movable jointed doll 1; a pair of right and left huckle bone members 18, 19 provided pivotably with the coxa member 11; a pair of right and left groin members 30, 40 installed into installed spaces 23, 27 respectively formed at each of the huckle bone members 18, 19; the groin members 30, 40 having protruded fitted portions 33, 43 which insert into depressed fitted portions 22, 26 formed at gluteu maximus corresponding portion of the huckle bone members 18, 19 respectively; and each of the groin members 30, 40 further composed of first joint segments 31, 41 rotate respectively in relation to each of the huckle bone members 18, 19 such that right and left leg members 6, 7 move in the horizontal direction respectively and second joint segments 35, 45 combine integrally with the first joint segments 31, 41 in a face-contact state respectively in relation to each of the first joint segments 31, 41 such that the leg members 6, 7 are lifted in the fore direction respectively.

In the above-mentioned structure, the huckle bone member 18 further composed of a longitudinal slider wall 18*a,* an iliac muscle corresponding portion 18*b,* and a gluteu maximus corresponding portion 18*c.* The iliac muscle corresponding portion 18*b* is formed at an upper portion of the longitudinal slider wall 18*a* such that the iliac muscle corresponding portion 18*b* projects outwardly. The gluteu maximus corresponding portion 18*c* is provided consecutively with a lower portion to an angle state from the iliac muscle corresponding portion 18*b* to an angle state. Moreover, the second segment 35 of the groin portion 30 includes a base 37 and a vertical bearing portion 38. The base 37 touches to an edge portion of the iliac muscle corresponding portion 18*b* when the leg 6 is lifted in the fore direction to a horizontal state. The vertical bearing portion 38 extends upwardly from the outer surface of the base 37 and is closely related with the first joint segment 31.

Further, the coxa member 11 includes a coxa portion 13 composed of a control portion 15 for a huckle bone member and a stopper portion 16 for a huckle bone member. The bordering-shaped control portion 15 is formed at an edge portion of the front part of the coxa portion 13 and in an inclined-shape, the control portion 15 projecting in the right and left directions symmetrically. The stopper portion 16 for a huckle bone member is formed at an upper edge portion of a back part of coxa portion 13 and projects with a slight curve in the right and left directions symmetrically.

Moreover, the coxa member 11 is provided pivotably to the body 2, having a cylindrical insert axle 12 inserted into a vertical hole 8 formed at the body 2.

In addition, another huckle bone member 18 includes longitudinal slider wall 18*a* slides in contact with a side wall of the coxa portion 13 of the coxa member 11. The longitudinal slider wall 18*a* has a large diameter fitted axle portion 20 and a small diameter short axle 21. The axle portion 20 engages into the center hole 14 of the coxa portion 13. The short axle 21 is formed so as to protrude at a top end portion of the axle portion 20 and inserted into an fitted sleeve 25 formed so as to protrude at the longitudinal slider wall 19*a* of another huckle bone member 19.

BRIEF DESCRIPTION OF THE DRAWINGS

Each of drawings referring to FIGS. 1 to 18 shows an explanatory view respectively illustrating an embodiment of the present invention.

DESCRIPTION OF THE PREFERRED EMBODIMENT

Figure 1A:
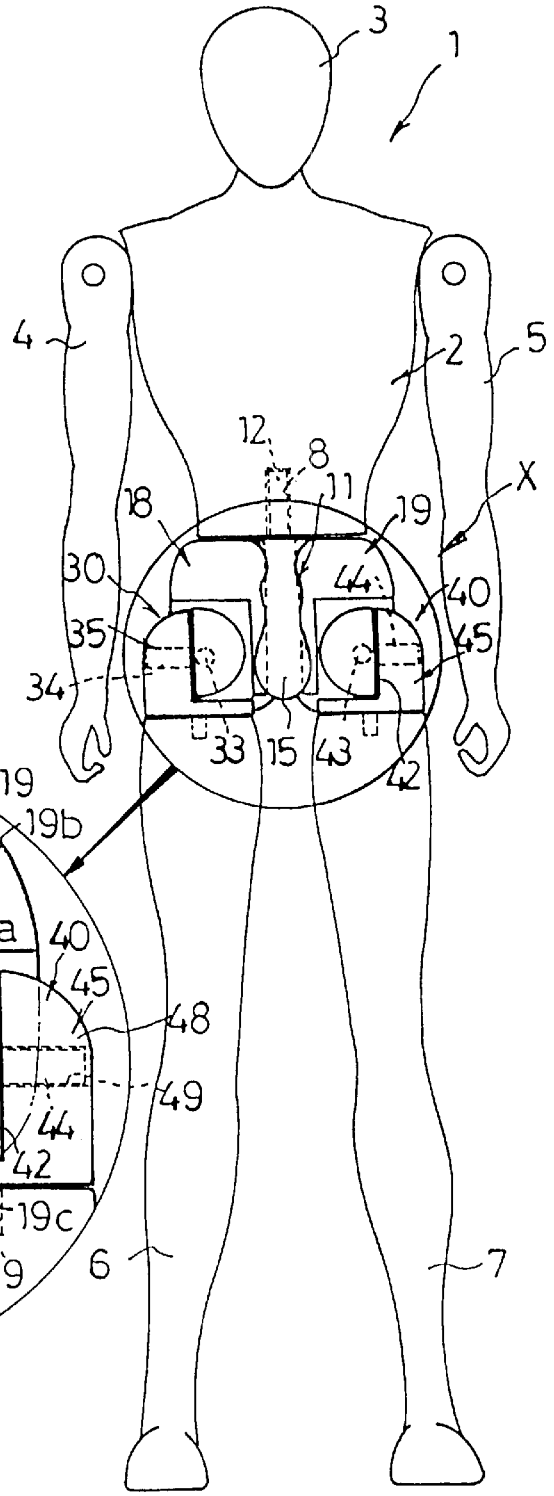
FIG. 1*a* is a front view of a movable jointed doll.
Figure 1B:
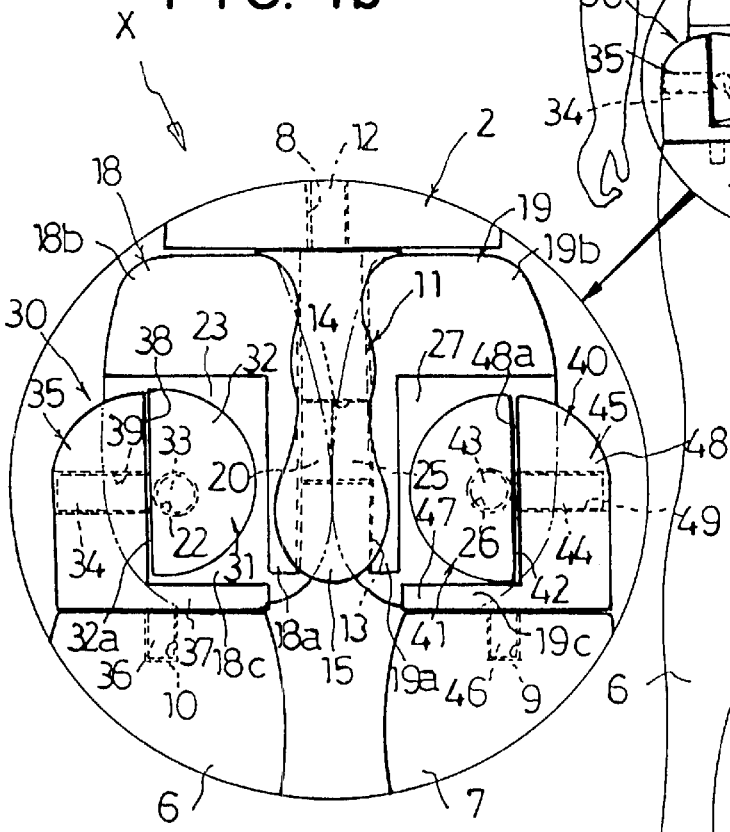
FIG. 1*b* is an expanded view showing details of a main part of the present invention shown in FIG. 1*a;*
Figure 2A:
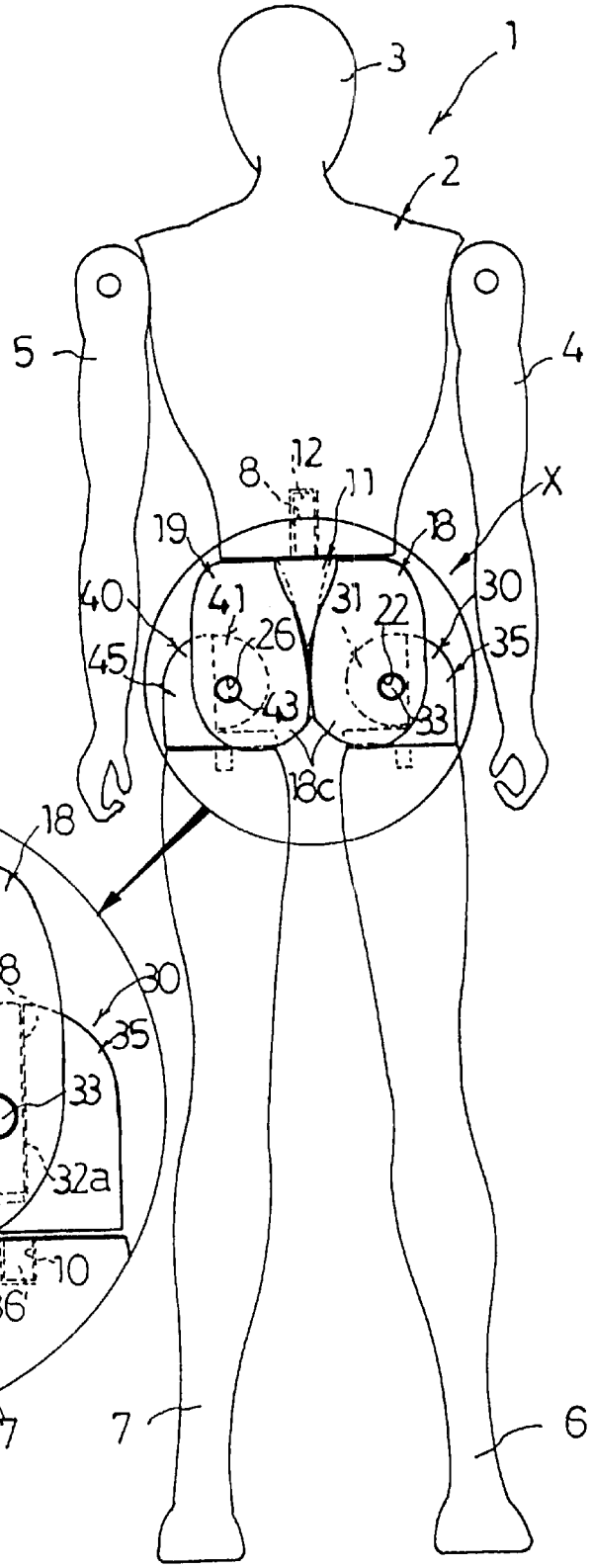
FIG. 2*a* is a back view based on FIG. 1.
Figure 2B:
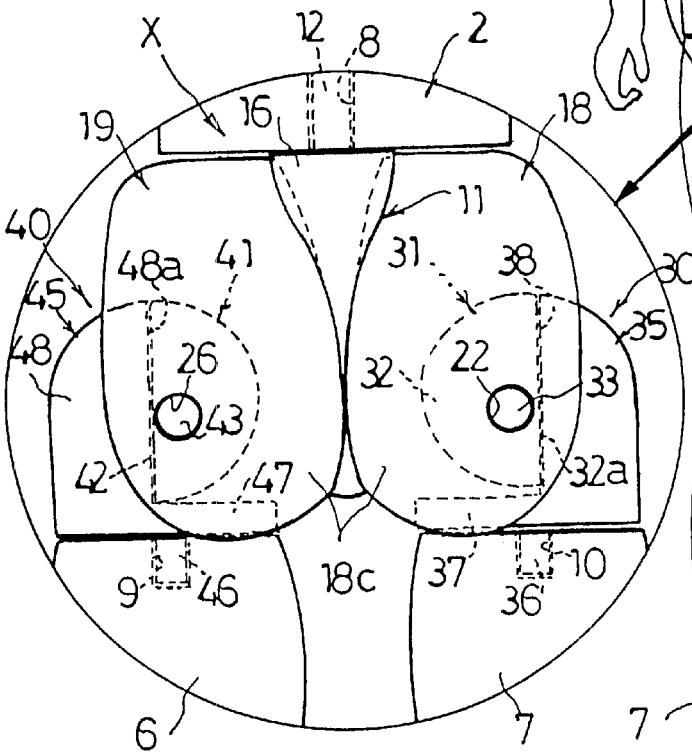
FIG. 2*b* is an expanded view showing details of a main part of the present invention shown in FIG. 2*a;*
Figure 3A:
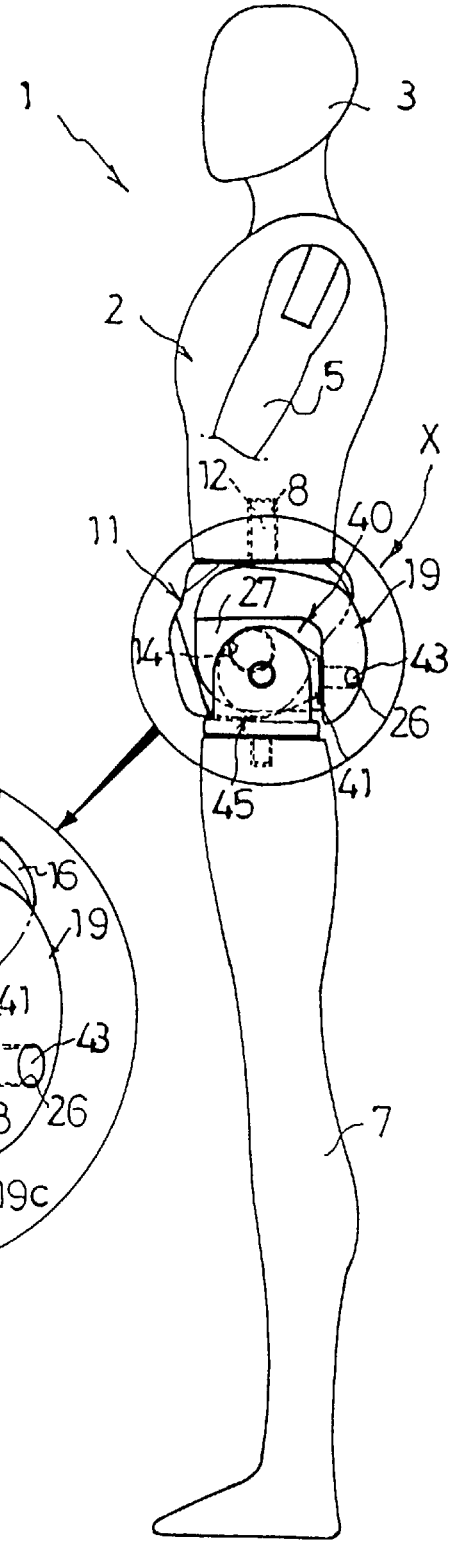
FIG. 3*a* is a right side view based on FIG. 1, and an expanded view showing details of a main part of the present invention shown in FIG. 3*b*.
Figure 3B:
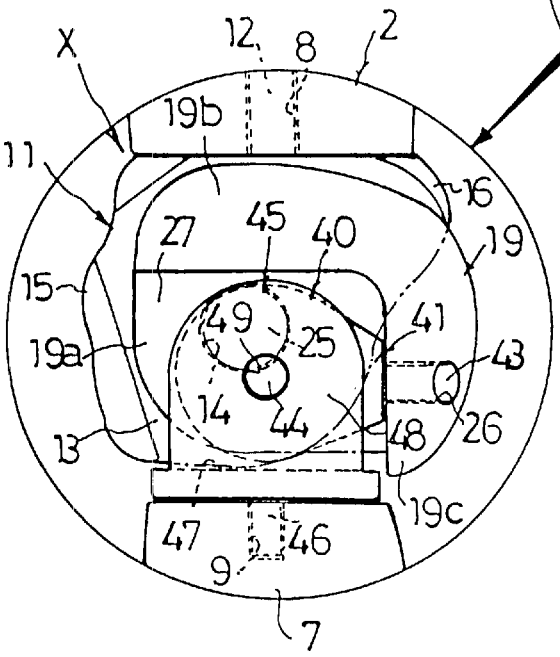

A movable structure for loin and groin of a movable jointed doll of the present invention is described in more detail referring to FIGS. 1 to 18 of the accompanying drawings. At first, FIG. 1 shows a front view of a movable jointed doll X made of hard synthetic resin, FIG. 2 shows a back view based on FIG. 1, and FIG. 3 shows a right side view based on FIG. 1. FIGS. 1 to 3 show one of examples showing the embodiment of the present invention respectively. Particularly, the main part of the present invention is pull out by an arrow and shown as expanded drawings respectively. The movable jointed doll 1 is provided pivotably a head portion 3 including a neck portion and right and left arms 4, 5 as a matter of course. Also a pair of leg members 6, 7 are each supported pivotably through a movable structure for loin and groin as the main part of the present invention. Then, the drawing for a joint structure such as elbows of the arms 4, 5 and knees of the leg members 6, 7 are not shown thererin because their structure has nothing to do with the structure of the present invention.

Figure 4:
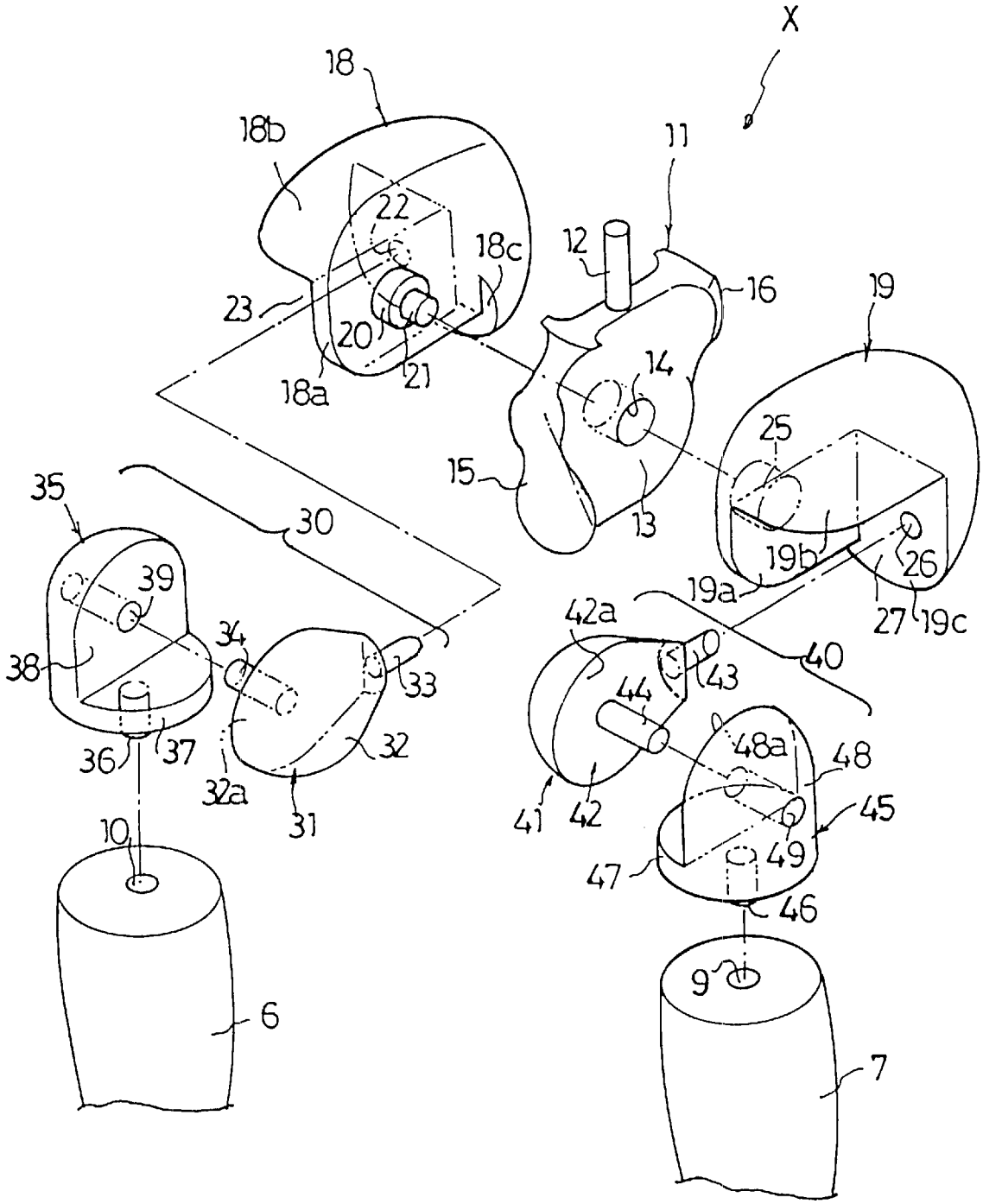
FIG. 4 is an exploded perspective view showing a main part of the present invention.

Then, FIG. 4 is an exploded view showing each member composing the main part of the present invention. Also, FIGS. 5 to 15 shows each of explanatory views showing a figure or a combination state for each of members which is shown in FIG. 4.

Each of members comprising the main part of the present invention is described more detail referring to drawings.

Figure 5:
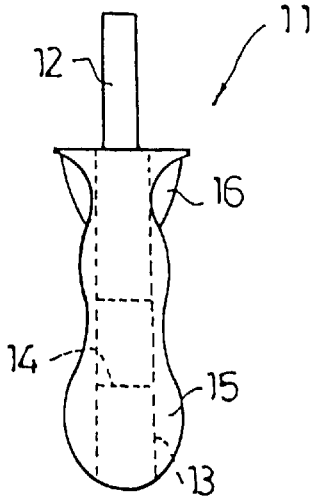
FIG. 5 is a front view of a coxa member.
Figure 6:
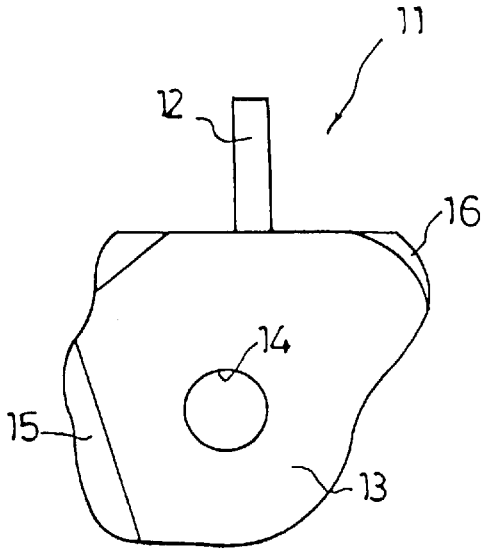
FIG. 6 is a right side view of a coxa member.

Numeral 11 indicates a coxa member forcibly which inserts into a vertical hole 8 formed at a central portion on a horizontal lower surface of aforesaid body 2. FIG. 5 is a front view of the coxa member 11. FIG. 6 is a right side view of the coxa member 11. Now, an appearance of the coxa member 11 is described referring to the drawings. The coxa member 11 is composed of an insert axle 12 formed in a shape of a cylinder and a coxa portion 13 formed in a shape of a partition wall. The insert axle 12 is pressed into the vertical hole 8 of the body. The coxa portion 13 is formed integrally at a lower end of the inserted axle 12. A central hole 14 is formed at a central portion of the coxa portion 13 and crosses to the insert axle 12.

The bordering-shaped control portion 15 is provided at an edge portion of the front part of the coxa portion 13 and formed in an inclined shape, the control portion 15 projecting to a right and left directions symmetrically. The stopper portion 16 for a huckle bone member is provided at an upper edge portion of a back part of coxa portion 13 and projects with a slight curve in the right and left directions symmetrically.

Figure 7:
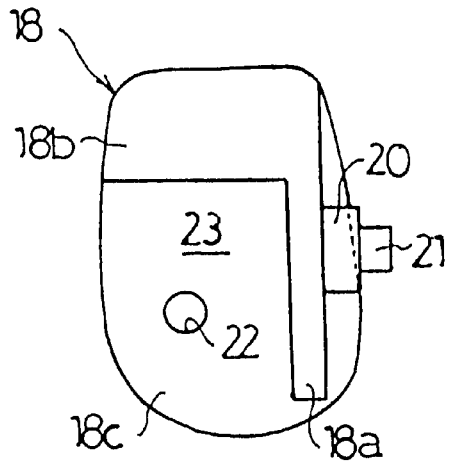
FIG. 7 is a front view of a left huckle bone member.
Figure 8:
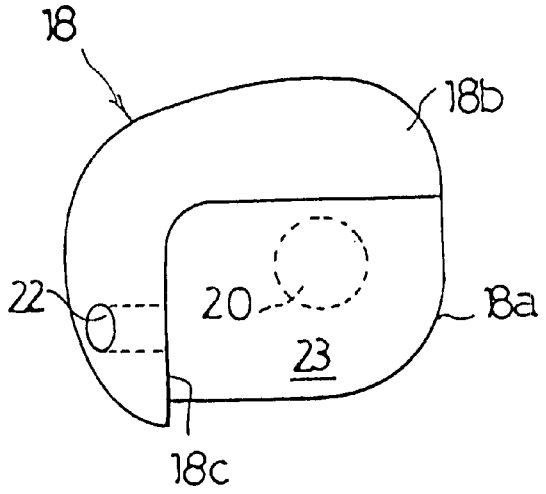
FIG. 8 is a left side view of a left huckle bone member.
Figure 11:
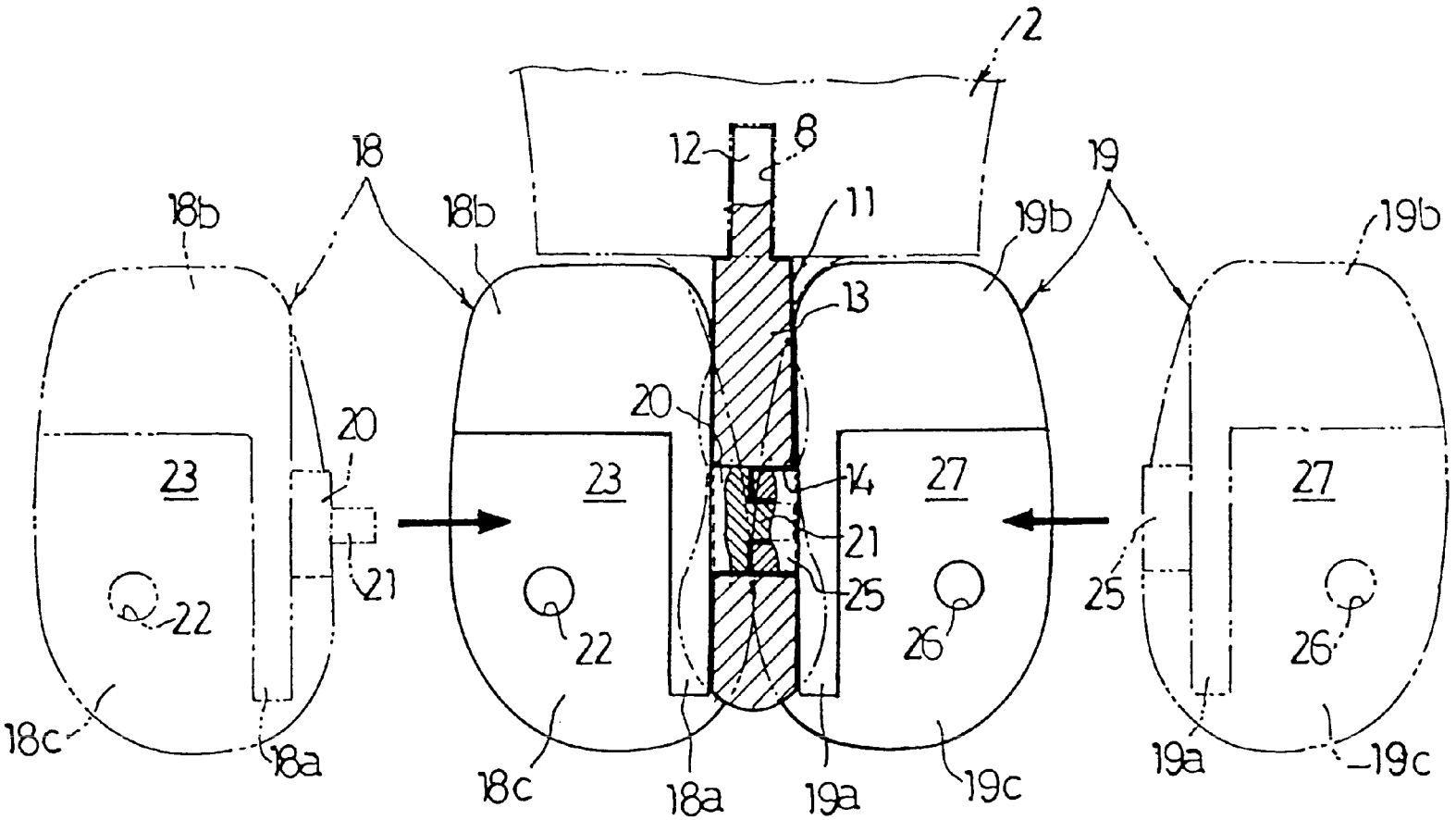
FIG. 11 is a schematic explanatory view in case that right and left huckle bone member are installed with a coxa member.
Figure 12:
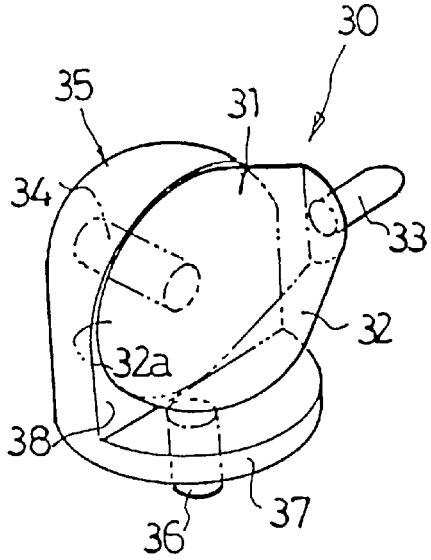
FIG. 12 is a schematic explanatory view of a left groin member.
Figure 13:
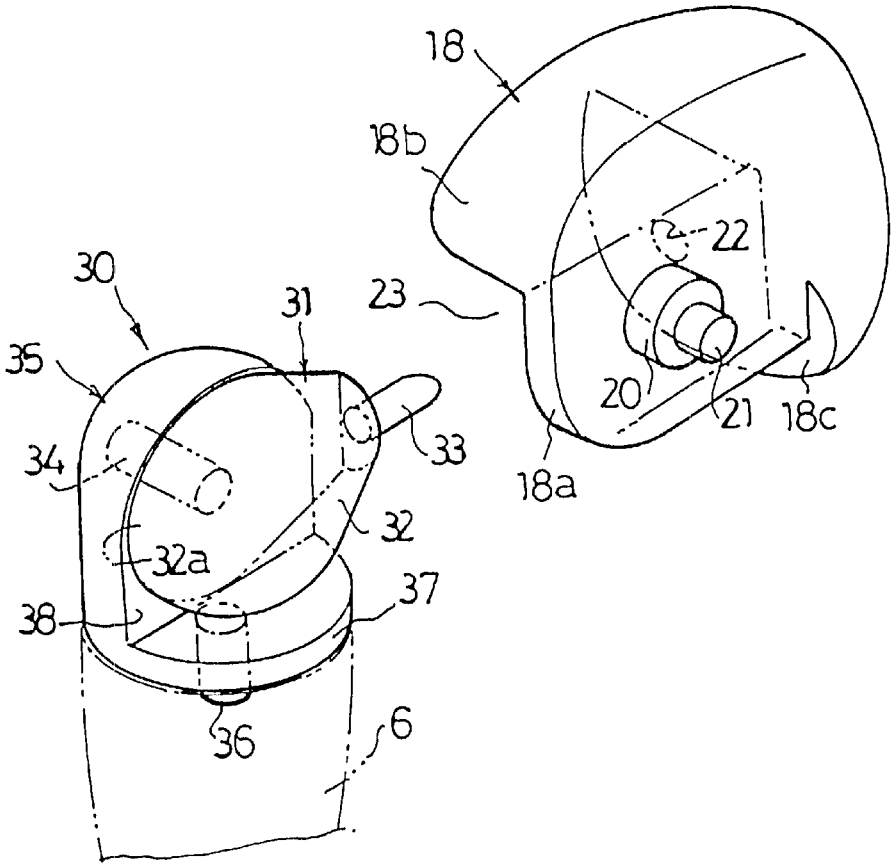
FIG. 13 is an explanatory view showing the way in which a left groin member and left huckle bone member are combined.
Figure 14:
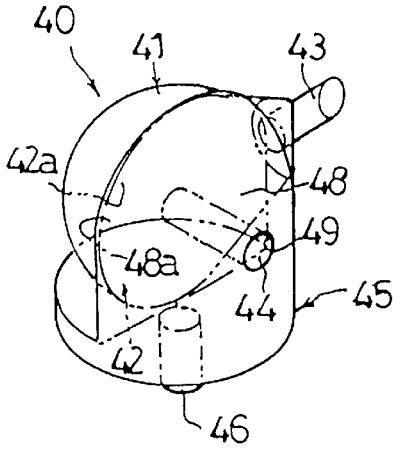
FIG. 14 is a schematic explanatory view of a right groin member.
Figure 15:
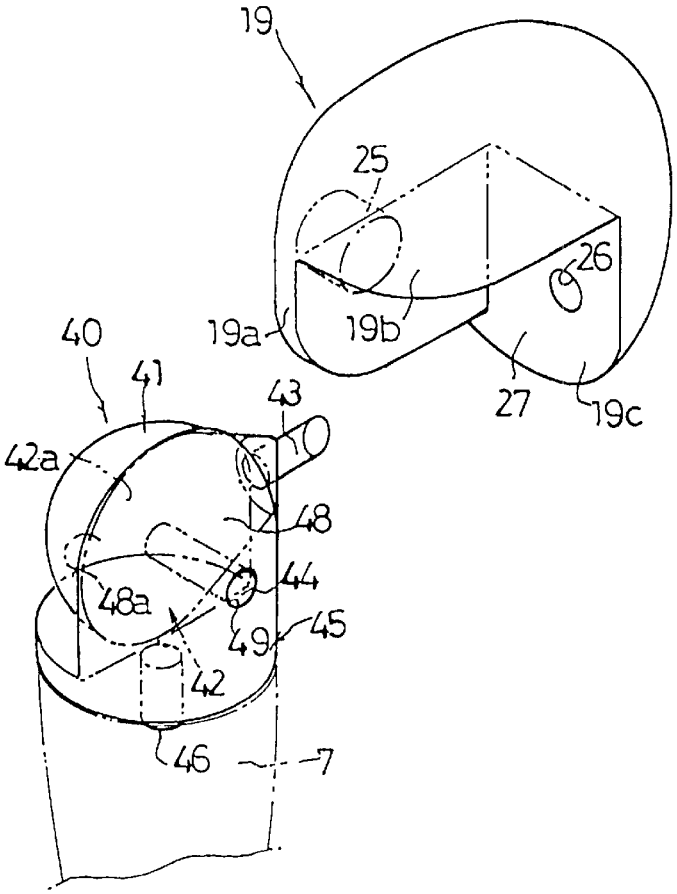
FIG. 15 is an explanatory view showing the way in which a right groin member and right huckle bone member are combined.

Numerals 18 and 19 as shown in FIG. 11 indicate a pair of huckle bone member installed with the right and left coxa members 11 respectively such that they can rotate pivotably to a predetermined angle. In this embodiment, as shown in FIG. 11, numeral 18 indicates a left huckle bone member, the numeral 19 is a right huckle bone member. FIGS. 7 and 8 show front and left side views illustrating the left huckle bone member 18. Then, the left bone member 18 is described referring to these drawings. Numeral 18*a* is a longitudinal slider wall slides in contact along a left side wall of the coxa portion 13 of the coxa member 11, the slider wall 18*a* having an large diameter fitted axle portion 20 formed with projection at a central portion thereof The axle 20 is fitted and inserted onto the central hole 14 of the coxa portion 13. Further, a small diameter short axle 21 is formed at a top end portion of the fitted axle 20 as an engaging portion that protrudes from the central hole 14 a little.

Numeral 18*b* indicates a thick iliac muscle corresponding portion formed at an upper portion of the longitudinal slider wall 18*a* such that the iliac muscle corresponding portion 18*b* projects outwardly (left side). An upper wall surface of the iliac muscle corresponding portion 18*b* is formed as an expanded shape, and an lower inner wall of a bottom surface thereof is formed to a horizontal state. Additionally, numeral 18*c* indicates a gluteu maximus corresponding portion which formed at a back portion of the longitudinal slider wall 18*a* such that the gluteu maximus corresponding portion 18*c* projects outwardly (left side), the gluteu maximus corresponding portion 18*c* forming consecutively below the iliac muscle corresponding portion. The outer wall surface of the gluteu maximus corresponding portion 18*c* is formed in an expanded shape in the same manner as the iliac muscle corresponding portion 18*b,* and an inner wall surface of the gluteu maximus corresponding portion 18*c* is formed in a vertical state. Moreover, an axle hole 22 defining a through hole as a depressed engaging portion is formed at a central portion of the gluteu maximus corresponding portion in the vertical direction. Accordingly, iliac muscle corresponding portion 18*b* and the gluteu maximus corresponding portion 18*c* of the left huckle bone member 18 are formed in an angle-shape as a whole. Moreover, a portion corresponding to pubic muscle as it were acts as an installed space 23 for the groin member as will be described later.

Figure 9:
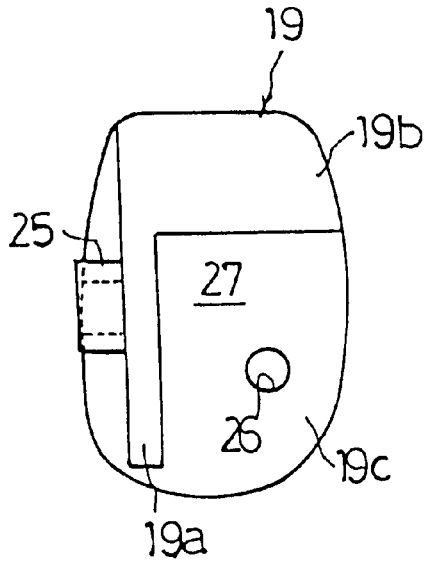
FIG. 9 is a front view of a right huckle bone member.
Figure 10:
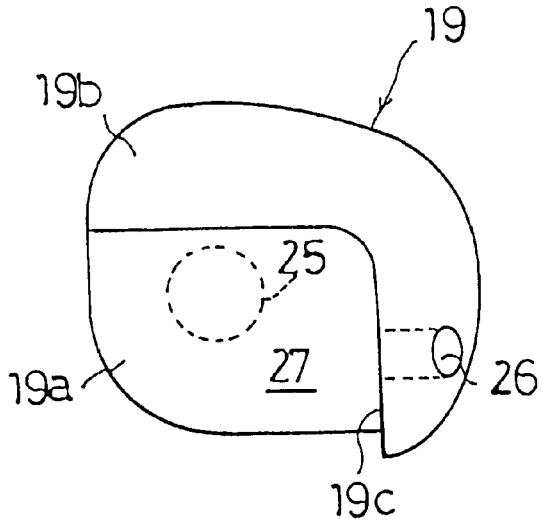
FIG. 10 is a right side view of a right huckle bone member.

FIGS. 9 and 10 show a front and right side views for the right huckle bone member 19. Then the right huckle bone member is described referring to the drawings. Numeral 19*a* indicates a longitudinal slider wall that slides in contact along a right side wall of the coxa portion 13 of the coxa member 11. A fitted sleeve 25 as a non-fitted portion is formed so as to protrude at a central portion of the longitudinal slider wall 19*a,* the sleeve being fitted and inserted onto the central hole 14 defining a through hole of the coxa portion 13 and being impacted the short axle 21 of the left huckle bone member 18 therein.

Numeral 19*b* indicates a thick iliac muscle corresponding portion formed at an upper portion of the longitudinal slider wall 19*a* such that iliac muscle corresponding portion 19*b* projects outwardly (right side). An upper wall surface of the iliac muscle corresponding portion 19*b* is formed in an expanded shape, and an inner wall surfaced thereof is formed to a horizontal state. Additionally, numeral 19*c* indicates a gluteu maximus corresponding portion formed at a back part of the longitudinal slider wall 19*a* such that the gluteu maximus corresponding portion 19*c* projects outwards (right side), the gluteu maximus corresponding portion 19*c* forming consecutively below the iliac muscle corresponding portion 19*b*. The outer wall surface of the gluteu maximus corresponding portion 19*c* is formed in an expanded shape in common with the iliac muscle corresponding portion 19*b*, and an inner wall surface of the gluteu maximus corresponding portion 19*c* is formed to a vertical state. Moreover, an axle hole 26 defining a through hole as an engaging depression is formed at a central portion of the gluteu maximus corresponding portion 19*c* in the vertical direction. Accordingly, the iliac muscle corresponding portion 19*b* and gluteu maximus corresponding portion 19*c* of the right huckle bone member 19 are also formed symmetrically with comparison to the left huckle bone member. Moreover, the portion corresponding to pubic muscle as it were act as an installed space 27 for a groin member as will be described later.

The groin members 30, 40 are described referring to FIG. 4 and FIGS. 12 to 15. The groin members 30, 40 are provided pivotably into the installed spaces 23, 27 of the right and left huckle bone members 18, 19 respectively. Now, the groin members 30, 40 of the present invention are formed symmetrically. Therefore, the structure of groin member 40 is described at details below, and another groin member 30 will be described simply as will be described later.

Numeral 41 indicates a first joint segment that is fixed pivotably to the right huckle bone member 19. The first joint segment 41 is composed of a connected portion 42 formed in a hemisphere shape (shape like a half of a pear), a horizontal axle 43 as a protruded engaging portion and a projected axle 44. The horizontal axle 43 is provided at a back end portion of the connected portion 42 and extends in the horizontal direction, the axle 43 matching and fitting to the axle hole 26 of the right huckle bone member 19. The projected axle 44 is formed on a vertical joint surface 42*a* of the connect portion 42 so as to protrude such that the projected axle crosses to the horizontal axle 43.

Moreover, numeral 45 indicates a second joint segment is fixed pivotably to an upper end portion of the leg member 7. The second joint segment 45 is composed of a base 47 formed in a shape of a circle, a vertical bearing portion 48 and an engaged hole 49. The base 47 includes a vertical axle 46 impacted into the vertical fitted hole 9 formed at an upper end portion of the leg member 7. The vertical bearing portion 48 extends from an outer surface (right side) of the base 47 upwardly and formed in a shape of a fingertip. The hole 49 defining a through hole is formed at a portion adjacent upper portion or a central portion of the bearing portion 48 and receives to impact the projected axle 44 of the first joint segment 41 therein.

The outer wall surface provided the projected axle 44 of the connected portion 42 of the first joint segment defines a vertical joint surface 42*a*. Further, an inner wall of the vertical bearing portion 48 of the second joint segment 45 which joints with the vertical joint surface 42*a* defines a longitudinal slider surface 48*a*. Therefore, when the projected axle 44 of the first joint segment inserts into the hole 49 of the second joint segment 45, the vertical joint surface 42*a* of the first segment 41 and longitudinal slider surface 48*a* of the second joint segment 45 joint perfectly and combine integrally each other.

Further, another groin member 30 is described simply as follows:

Numeral 31 indicates a first joint segment attached pivotably to the left huckle bone member. Numeral 32 indicates a joint portion of the first joint segment. Numeral 32*a* indicates a joint surface. Numeral 33 indicates a horizontal axle as a protruded engaging portion. Moreover, numeral 34 indicates a projected axle. In addition, numeral 35 indicates a second joint segment attached pivotably to an upper end portion of the leg 6, numeral 38 indicates a vertical bearing, portion, and numeral 39 indicates a fitted hole.

Based on the structure already mentioned, the assembling of members is as follows:

At first, coxa member 11 is provided with the body 2. In this case, the assembling will be supported the coxa member 11 from both sides by the thumb and forefinger thereof impacted insert axle 12 into the vertical hole 8 of the body 2. If the coxa member 11 is combined with the body 2 through the insert axle 12, it can rotate pivotably.

Figure 16:
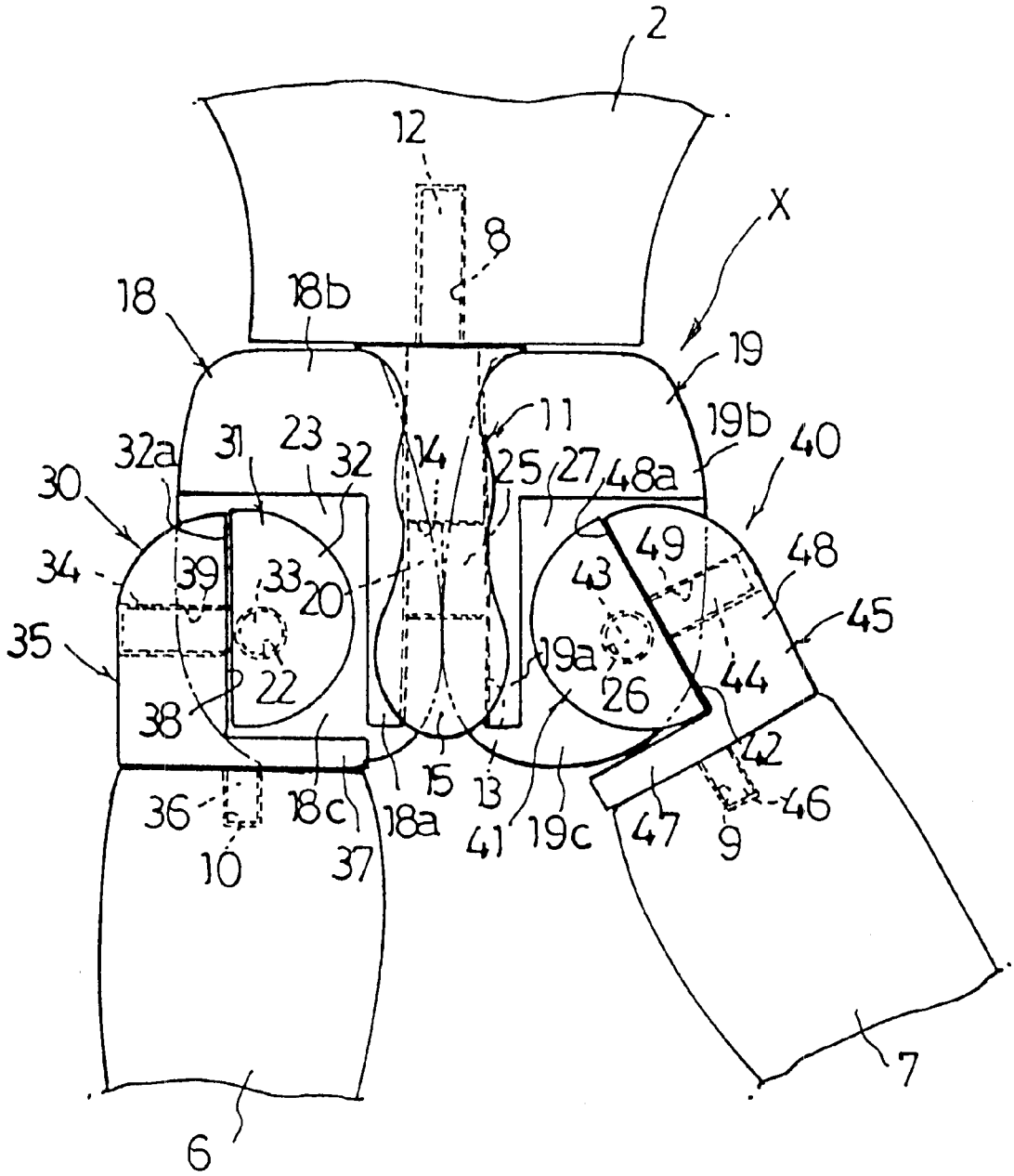
FIG. 16 is an explanatory view showing an example that both legs open in a horizontal direction.

Next, the groin members 30, 40 corresponding to each of the right and left huckle bone members 18, 19 are installed with the huckle bone members 18, 19 respectively. In this embodiment, referring to FIG. 4, the left groin member 30 is installed into the installed space 23 of the left huckle bone member 18 through the first joint segment 31. Moreover, the right groin member 40 is installed into the installed space 27 of the right huckle bone member 19 through the first joint segment 41. In case of such condition, the first joint segments 31, 41 are attached movably to the huckle bone members 18, 19 respectively through the horizontal axles 33, 43 impacted into the axle holes 22, 26 of the huckle bone members 18, 19 such that the first joint segments 31, 41 move in the horizontal direction from the predetermined vertical position (for example, direction lifted the leg 7 in the right direction as shown in FIG. 16). Accordingly, when the first joint segments 31, 41 are lifted in the horizontal direction from the predetermined vertical position respectively, the second joint segments 35, 45, as already mentioned, are respectively supported pivotably by the first joint segments 31, 41 in relation that the second joint segments 35, 45 are closely related with the first joint segments 31, 41 and contact each other, so that the second joint segments 35, 45 move in the horizontal direction respectively by movement of the first joint segments 31, 41.

Further, the left huckle bone member 18 installed the groin member 30 is provided with the left side wall of the longitudinal slider wall 18*a* of the coxa member 11. At the same time, when the axle 20 of the left huckle bone member 18 engages with the center hole 14 of the coxa portion 13, the small diameter short axle 21 projects from the surface of the right side wall of the longitudinal slider wall 18*a* a little. Accordingly, the right huckle bone member 19 installed the groin member 40 beforehand is provided with the left and right side walls of the longitudinal slider wall 18*a* of the coxa member 11, and the small diameter short axle 21 is impacted into the sleeve 25. Therefore, the left and right huckle bone members 18, 19 are connected integrally. The above-described huckle bone members 18, 19 can move freely in the fore direction while they slide in contact along the longitudinal slider wall 18*a* (the direction to lift the leg 7 to the left side points to the direction to lift the leg in the fore direction, as shown in FIG. 7).

Finally, the vertical axles 36, 46 of the second joint segments 35, 45 of the right and left groin members 30, 40 are inserted respectively into the holes 10, 9 of the corresponding leg members 6, 7.

Figure 17:
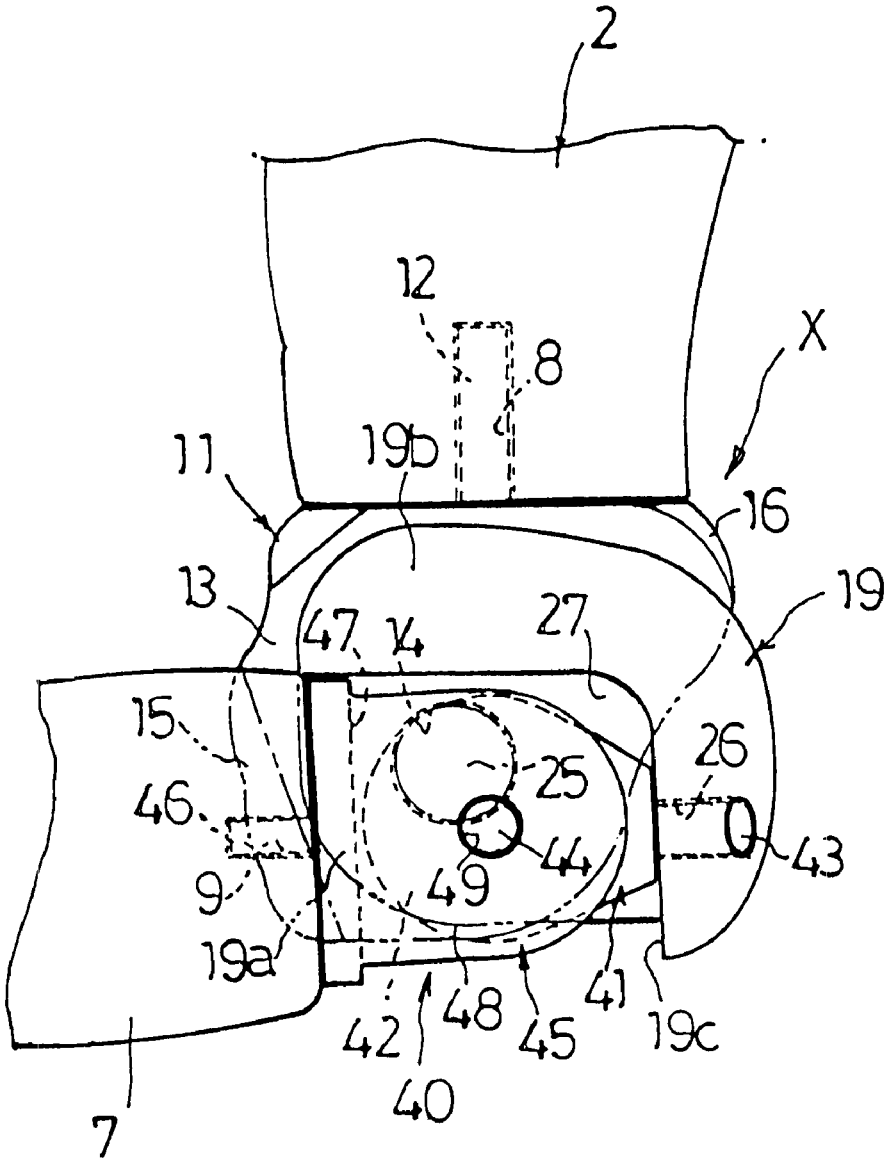
FIG. 17 is an explanatory view showing the way in which are lifted substantially up to a horizontal state in the fore direction; and FIG . 18 is an explanatory view the way in which the legs is moved up to a V-shaped state.
Figure 18:
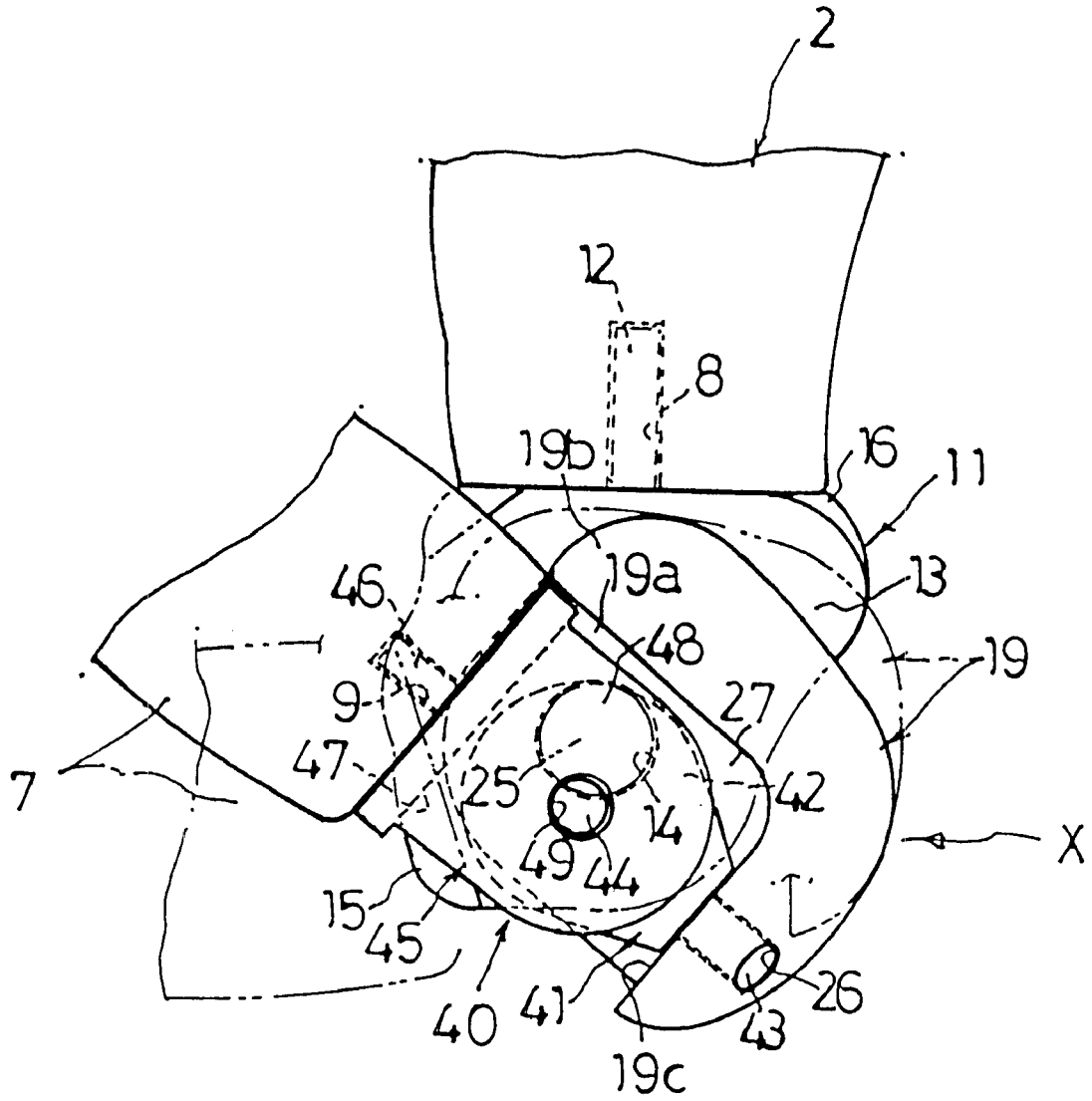

Therefore, the movement of the leg members 6, 7 of the movable jointed doll 1 is as follows:

When the leg member 7 opens in the horizontal direction as shown in FIG. 16, for example, the groin member 40 will rotates through the first joint segment 41 to the right huckle bone member 19. Additionally, when they are lifted in the fore direction as shown in FIGS. 17 and 18, for example, the second joint segment 45 rotates up to a horizontal position substantially while it slides in contact along the first joint segment 41 into facing contact. Moreover, when the leg member 7 is lifted upwardly still more, the right huckle bone member 19 maintains a lifted-up state by the base 47 of the second joint segment 45. Accordingly, the right huckle bone member 19 rotates as far as the movement allows stopping by the inclined control portion 15 of the coxa member 11. Therefore, the leg members 6, 7 of the movable jointed doll 1 rotate pivotably and upwardly such that its movement gives us a good impression on a great pliability.

Further, the right and left huckle bone members 18, 10 of the movable jointed doll 1 rotate pivotably through the coxa member 11.

In this case, since each of leg members 6, 7 of the movable jointed doll 1 is controlled by each of the symmetrical corresponding stoppers 16 of the coxa member 11 to the right and left huckle bone members 18, 10 respectively, the leg members 6, 7 do not rotate in the back direction from the position in which they is provided at a predetermined place.

In the first embodiment, in case that right and left huckle bone members are installed pivotably with the coxa member 11, the center hole 14 is not always formed at the coxa portion 13 of the coxa member 11. For example, the assembly may be formed the engaging protrusion at the right and left sides at the coxa member 13, the huckle bone members 18, 19 having non-engaging depression engages with the engaged protrusions may be installed pivotably with the coxa member 11. Also, in case that the groin members 30, 40 are supported pivotably by the huckle bone members 18, 19 through the first joint segments 31, 41 respectively, the relation between the projected portions 33, 44 and the depressed fitted portions 22, 26 may be formed reversibly. Furthermore, in the relation between the coxa member 11 and the body 2, the projected fitted portion 12 (inserting axle) and the depressed fitted portion (vertical hole) may invert, and the structure may be changed through a design change optionally. The preferred embodiments described herein are therefore illustrative and not restrictive, the scope of the invention being indicated by the appended claims and all variations which come within the meaning of the claims are intended to be embraced therein.

The advantages of the present invention are as follows:

(1) A movable structure for loin and groin of toy figures allows loin and groin portions to move in the same manner as human being naturally when the leg members of the doll are lifted in the front-back direction and/or the left-right direction respectively.

(2) Since a coxa member defining a partition wall is provided toward under the body, the huckle bone member and groin member can be jointed rationally.

(3) In a movable structure of the present invention described in claim 2, when the leg members of a doll are each lifted up to the horizontal state in the fore direction, the leg members can be lifted up to a V-shaped state as the huckle bone member allows to rotate.

(4) In a movable structure of the present invention described in claim 3, the range of rotation of the leg member can be controlled it's movement in the same manner as the range of rotation of the leg of human being.

What is claimed is:

1. A movable structure for loin and groin of toy figures, comprising:

a coxa member (11) formed as a partition wall and attached to a lower portion of a body (2) of a movable jointed doll (1);

a pair of right and left huckle bone members (18, 19) installed pivotably with said coxa member (11);

a pair of right and left groin members (30, 40) installed into installed spaces (23, 27) respectively formed at each of said huckle bone members (18, 19); and said groin members (30, 40) having protruded portions (33, 43) which insert into depressed portions (22, 26) provided at gluteu maximus corresponding portions of said huckle bone members (18, 19) respectively; said groin members (30, 40) including first joint segments (31, 41) that rotate respectively in relation to each of said huckle bone members (18, 19) such that right and left leg members (6, 7) move in a horizontal direction respectively, and second joint segments (35, 45) for connecting leg members provided with said first joint segments (31, 41) so as to closely relate and contact therewith and combined integrally through projected axles (34, 44) respectively, said second joint segments (35, 45) rotate in relation to said first joint segments (31, 41) such that said leg members (6, 7) are pushed in a fore direction, respectively.

2. A movable structure for loin and groin of toy figures according to claim 1 wherein:

said huckle bone member (18) including a longitudinal slider wall (18*a*), an iliac muscle corresponding portion (18*b*) formed at an upper portion of the longitudinal slider wall (18*a*) such that said iliac muscle corresponding portion (18*b*) projects outwardly, and a gluteu maximus corresponding portion (18*c*) which is provided consecutively with a lower portion to an angle state toward said iliac muscle corresponding portion (18*b*); and said second segment (35) of said groin member (30) including a base portion (37) touches intimately to an edge portion of said iliac muscle corresponding portion (18*b*) when said leg member (6) is moved up to a horizontal state in a fore direction and a vertical bearing portion (38) extends upwardly from an outer surface of said base portion (37) and is closely related with said first joint segment (31) and contacts each other.

3. A movable structure for loin and groin of toy figures according to claim 1 wherein:

said coxa member (11) includes a coxa portion (13) comprising a control portion (15) for said huckle bone member having an edged shape that projects in right and left directions symmetrically, said control portion being formed at an edge portion of a front part of said coxa portion to an inclination state, and a stopper (16) for said huckle bone member formed at an upper edge portion of a back part of said coxa member, said stopper protruding symmetrically in right and left directions at a slight curve.

4. A movable structure for loin and groin of toy figures according to claim 1, wherein said coxa member (11) is provided pivotably with said body 2, said coxa member (11) having a cylindrical insert axle (12) inserted into a hole (8) defining a vertical state of said body (2).

5. A movable structure for loin and groin of toy figures according to claim 1, wherein one of said huckle bone members (18) including a longitudinal slider wall (18*a*) which slides in contact along one of the side walls of said coxa portion (13) of said coxa member 11, and said longitudinal slider wall (18*a*) including a large diameter fitted axle portion (20) fits onto a center hole (14) of said coxa portion (13) and a small diameter short axle (21) formed so as to protrude at a top portion thereof and inserted into a fitted sleeve (25) formed so as to protrude at a longitudinal slider wall (19*a*) of another huckle bone member (19).

* * * * *